US006295943B1

(12) United States Patent
Brushaber et al.

(10) Patent No.: US 6,295,943 B1
(45) Date of Patent: Oct. 2, 2001

(54) TOWING APPARATUS FOR PERSONAL WATERCRAFT

(76) Inventors: Donald O. Brushaber, 709 Burnt Tavern Rd., Point Pleasant, NJ (US) 08742; Donald Brushaber, 221 Hayes Ct., Normandy Beach, NJ (US) 08739

( * ) Notice: Subject to any disclaimer, the term of this patent is extended or adjusted under 35 U.S.C. 154(b) by 0 days.

(21) Appl. No.: 09/459,012

(22) Filed: Dec. 10, 1999

(51) Int. Cl.[7] ..... B63B 21/04

(52) U.S. Cl. ..... 114/253; 114/242; 114/249; 441/69

(58) Field of Search ..... 114/215, 242, 114/249, 250, 253; 441/65, 68, 69, 71, 72, 73, 75

(56) References Cited

U.S. PATENT DOCUMENTS

| | | | | |
|---|---|---|---|---|
| 2,117,322 | * | 5/1938 | Hillman | 114/253 |
| 2,991,524 | * | 7/1961 | Dobrikin | 24/73 |
| 3,034,469 | | 5/1962 | Allen . | |
| 3,094,096 | * | 6/1963 | Florence | 114/253 |
| 3,353,817 | * | 11/1967 | Bol | 114/253 |
| 3,610,447 | | 10/1971 | Ortiz . | |
| 4,108,101 | | 8/1978 | Schirtzinger . | |
| 4,598,882 | | 7/1986 | Opdahl . | |
| 4,947,779 | | 8/1990 | Grinde | 114/250 |
| 5,118,127 | | 6/1992 | Partington . | |
| 5,163,860 | * | 11/1992 | Clark | 441/65 |
| 5,188,054 | | 2/1993 | Jacobs, Jr. | 114/250 |
| 5,819,680 | * | 10/1998 | Haller et al. | 114/253 |
| 6,012,407 | * | 1/2000 | Farley | 114/215 |
| 6,145,462 | * | 11/2000 | Aquino | 114/253 |

* cited by examiner

*Primary Examiner*—Russell D. Stormer
*Assistant Examiner*—Lars A. Olson
(74) *Attorney, Agent, or Firm*—Arthur Jacob

(57) ABSTRACT

Towing apparatus for towing a personal watercraft at a desired distance behind a tow boat includes towing units having straight tubular walls, the towing units diverging from the personal watercraft toward the tow boat, each towing unit including a central tow line tensioned between the ends of the tubular wall, with each tubular wall in compression, enabling managed flexing of the wall of each towing unit for controlled lateral and altitudinal movements of the personal watercraft relative to the tow boat while maintaining the desired towing distance between the personal watercraft and the tow boat.

10 Claims, 3 Drawing Sheets

TOWING APPARATUS FOR PERSONAL WATERCRAFT

BACKGROUND OF THE INVENTION

Field of the Invention

The present invention relates generally to recreational marine equipment and pertains, more specifically, to towing apparatus for towing a personal watercraft behind a tow boat.

Personal watercraft, referred to as PWC, have become increasingly popular, and it has become common to tow one or more of these watercraft behind a larger powerboat or sailboat so as to have the personal watercraft available for use once the larger tow boat is moored. Because these personal watercraft are relatively small and are less stable in the water than are dinghies, inflatable boats and other small craft which usually are towed by a larger tow boat, a need has arisen for towing apparatus which will couple a towed personal watercraft to the larger boat for appropriate towing and other maneuvering without mishap.

BRIEF SUMMARY OF THE INVENTION

The present invention provides such towing apparatus and, as such, attains several objects and advantages, some of which are summarized as follows: Enables a personal watercraft to be attached to a tow boat with the range of movements of the personal watercraft being controlled relative to the tow boat for preventing mishaps, such as capsizing of the personal watercraft or collision of the personal watercraft with the tow boat or with other boats and structures in the vicinity; facilitates maneuvering of the tow boat with the personal watercraft attached, during towing over open water and while making way in more confined waters, such as in channels and harbors; allows for convenient selective attachment and detachment of a personal watercraft and a tow boat; enables appropriate movements of a towed personal watercraft relative to a tow boat during towing, while precluding excessive movements which could upset or otherwise damage the personal watercraft or damage the tow boat; controls movement of the towed personal watercraft relative to the tow boat during docking and mooring maneuvers of the tow boat for facilitating docking and mooring operations; provides a relatively simple and inexpensive towing apparatus for personal watercraft, adapted for use in connection with a wide variety of tow boats; protects against damaging or marring the personal watercraft, the tow boat, or structures in the vicinity during towing and mooring; provides towing apparatus of the type described having a rugged and durable construction for exemplary performance over an extended service life.

The above objects and advantages, as well as further objects and advantages, are attained by the present invention, which may be described briefly as towing apparatus for towing a personal watercraft at a desired towing distance behind a tow boat, the personal watercraft having a bow and a coupler adjacent the bow, and the tow boat having a stern, the towing apparatus comprising: first and second elongate towing units, each towing unit having a first end, and a second end spaced longitudinally from the first end; a linking member linking together the first ends of the elongate towing units, the linking member being linked to the first ends so as to enable the towing units to be spaced apart laterally from one another at the second ends; a first coupling adjacent the linked first ends of the towing units for coupling the towing units with the coupler of the personal watercraft; and a second coupling adjacent the second end of each of the towing units for coupling each second end to the stern of the tow boat, with the second ends being spaced apart laterally; each towing unit including a tow line extending longitudinally from the first end to the second end of the towing unit; a tensioning member extending longitudinally along the tow line from the first end to the second end of the towing unit, the tensioning member including a wall having longitudinally opposite ends, the wall being laterally flexible and longitudinally resistant to compression for enabling managed flexion of the tensioning member, the managed flexion allowing controlled flexing in lateral directions while resisting compression in longitudinal directions; and a securing arrangement at each end of the wall for securing the tow line at each end of the wall, with the tow line maintained in tension and the wall in compression for enabling the managed flexion; such that upon coupling the first coupling with the personal watercraft and coupling the second coupling with the tow boat, the managed flexion of the wall of each towing unit enables controlled lateral and altitudinal movements of the personal watercraft relative to the tow boat while maintaining the desired towing distance between the personal watercraft and the tow boat.

BRIEF DESCRIPTION OF THE SEVERAL VIEWS OF THE INVENTION

The invention will be understood more fully, while still further objects and advantages will become apparent, in the following detailed description of a preferred embodiment of the invention illustrated in the accompanying drawing, in which.

DETAILED DESCRIPTION OF THE INVENTION

Figure 1:
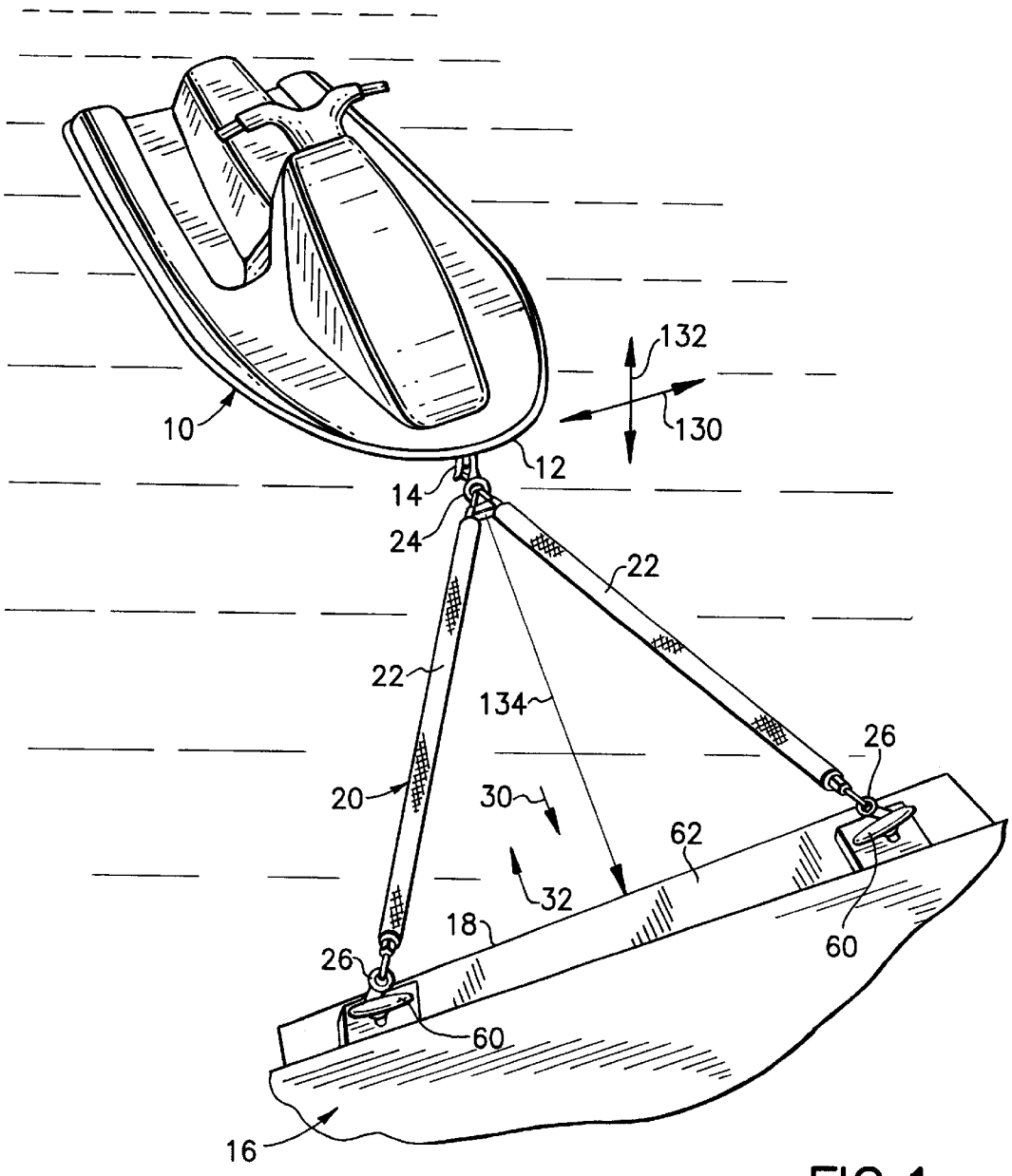
FIG. 1 is a pictorial perspective view of a personal watercraft being towed by a tow boat, utilizing apparatus constructed accordance with the present invention.

Referring now to the drawing, and especially to FIG. 1 thereof, a personal watercraft 10 is seen to have a bow 12, with a coupler 14 at the bow 12, and is shown being towed by a tow boat 16 having a stern 18, utilizing an apparatus constructed in accordance with the present invention, illustrated generally at 20.

Figure 2:
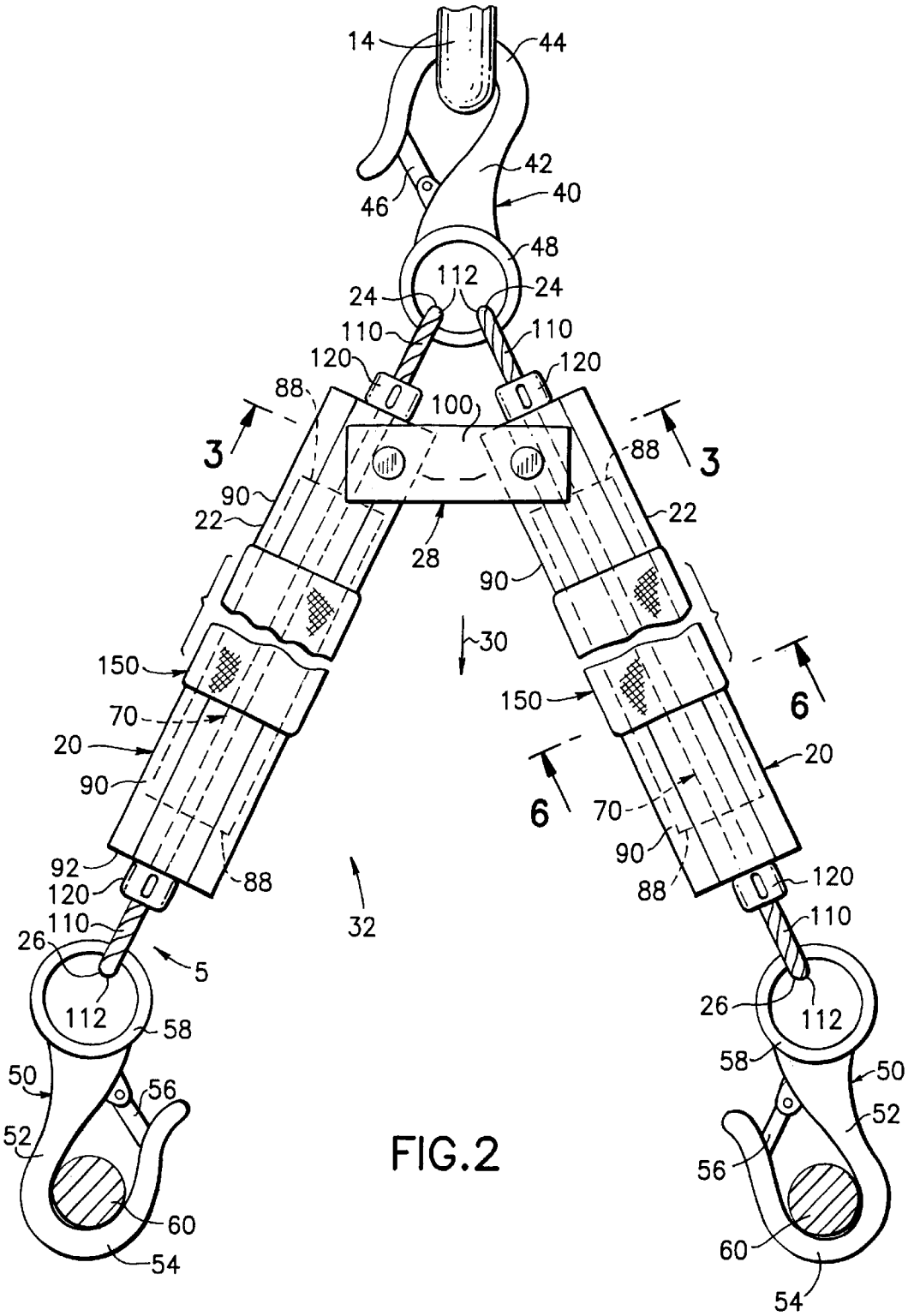
FIG. 2 is a top plan view of the apparatus, shown in place while towing a personal watercraft.

Turning now to FIG. 2, as well as to FIG. 1, towing apparatus includes a pair of first and second elongate towing units 22, each towing unit 22 extending longitudinally between a first end 24 and an opposite second end 26. A linking member 28 links together the first ends 24, in a manner to be described in further detail below, to bring and hold the first ends 24 in close proximity to one another, while enabling the towing units 22 to diverge from one another in the direction 30 from the first ends 24 toward the second ends 26, thereby placing the towing units 22 in a diverging array, as illustrated at 32.

A first coupling 40 adjacent the linked first ends 24 is shown coupling the towing units 22 to the personal watercraft 10 at the coupler 14. First coupling 40 is shown in the form of a snap-hook 42 having a now-conventional construction which includes a hook 44 and a latch 46 biased into a latching position, as shown, when the hook 44 is engaged with the coupler 14 of the personal watercraft 10. A ring 48 is integral with the hook 44 and is affixed to the towing units 22, as will be described in detail below. In a like manner, second couplings 50 are affixed to the towing units 22 adjacent the second ends 26 of the towing units 22, the second couplings 50 being in the form of snap-hooks 52 having a construction essentially the same as the snap-hook 42, with a hook 54, a biased latch 56 and an integral ring 58. Each hook 54 is engaged with a cleat 60 located on a swim platform 62 which forms a part of the stern 18 of the tow boat 16. Cleats 60 are spaced apart laterally so that the second ends 26 are spaced apart laterally in the diverging array 32.

Figure 3:
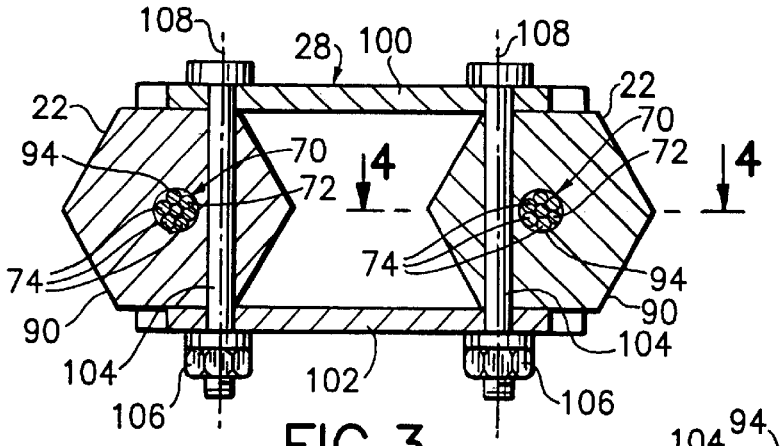
FIG. 3 is a cross-sectional view taken along line 3—3 of FIG. 2.
Figure 5:
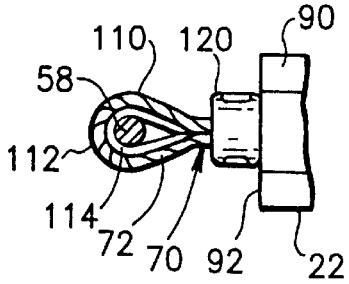
FIG. 5 is a fragmentary elevational view, partially sectioned, taken in the direction of the arrow in FIG. 2.
Figure 4:
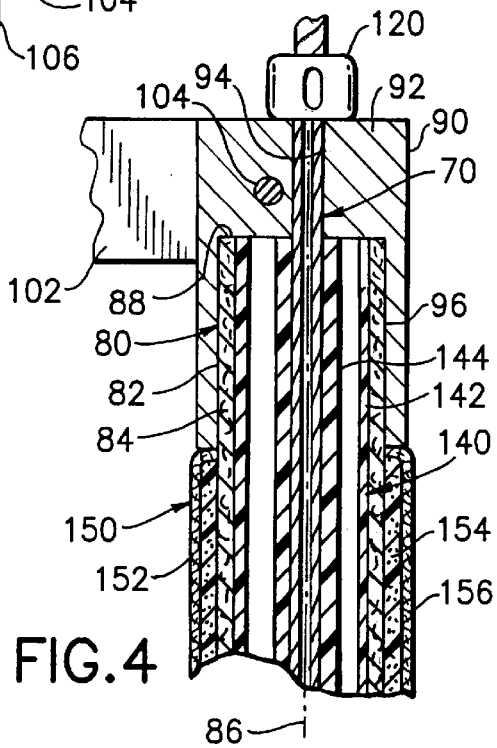
FIG. 4 is a cross-sectional view taken along line 4–4 of FIG. 3.

Turning now to FIGS. 3, 4 and 5, as well as to FIGS. 1 and 2, each of the towing units 22 includes a tow line 70 extending longitudinally from the first end 24 to the second end 26 of the towing unit 22, the tow line being shown in the preferred form of a wire rope 72 having a plurality of strands 74 of stainless steel wire. A tensioning member 80 extends longitudinally along the tow line 70 and preferably is in the form of a tubular member 82 having an essentially straight cylindrical wall 84 with a central longitudinal axis 86 and longitudinally opposite ends 88. Tubular member 82 is somewhat flexible in lateral directions, and resists compression in directions along axis 86, for purposes to be described more fully below. Thus, the preferred material for tubular member 82 is a fiber reinforced synthetic polymeric material, such as a fiberglass reinforced polyester, which possesses a whip-like lateral flexibility, resists longitudinal compression, and exhibits exemplary corrosion resistance. End caps 90 are affixed to the wall 84 adjacent each end 88 of the wall 84 so as to be integral with wall 84, and each end cap 90 includes an end wall 92 having an aperture 94 aligned with the central axis 86. End caps 90 preferably are constructed of a corrosion resistant metal, such as stainless steel, and are adhered in place by an adhesive applied at 96.

As best seen in FIG. 3, linking member 28 includes upper and lower links 100 and 102 which are pinned to end caps 90 by means of bolts 104 passing through the links 100 and 102 and the corresponding end caps 90, the bolts 104 being secured in place by nuts 106 and permitting pivotal movement of the towing units 22 relative to one another, about the pivotal axes 108 provided by the bolts 104. The bolts 104 are offset from central axis 86 so that the wire rope 72 of each tow line 70 remains aligned with central axis 86.

Tow line 70 is threaded through the apertures 94 of the end caps 90 of each towing unit 22 and terminates in a loop 110 at each end 112 of the tow line 70, the loop 110 surrounding a thimble 114 engaged with a corresponding ring 48 or 58. In the assembly of tow line 70 with tensioning member 80, the tow line 70 is pulled into tension and is maintained in such tension by a securing arrangement which includes a fitting 120 crimped onto the wire rope 72 to close the loop 110 and which is abutted against the end wall 92 of end cap 90 to maintain the tow line 70 in tension. At the same time, the cylindrical wall 84 of tubular member 82 is placed in compression. The combination of the tension in tow line 70, the resistance to longitudinal compression in tubular member 82, and the lateral flexibility of cylindrical wall 84, enables a managed flexion of tubular member 82, the managed flexion allowing controlled flexing in lateral directions while resisting compression in longitudinal directions, along central axis 86. Upon coupling the first coupling 40 with the personal watercraft 10, and coupling the second couplings 50 with the tow boat 16, as illustrated in FIGS. 1 and 2, the managed flexion of tubular member 82 of each towing unit 22 enables controlled lateral and altitudinal movements of the personal watercraft 10 relative to the tow boat 16, as indicated in FIG. 1 by arrows 130 and 132, respectively, while maintaining a desired towing distance 134 between the personal watercraft 10 and the tow boat 16. The towing distance is great enough to assure that the personal watercraft 10 will not be able to swing about and come into contact with the tow boat 16.

Figure 6:
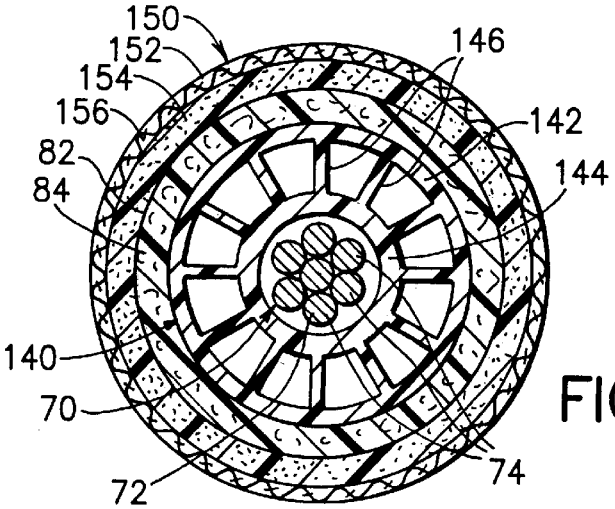
FIG. 6 is an enlarged fragmentary cross-sectional view taken along line 6—6 of FIG. 2.

Referring now to FIG. 6, as well as to FIG. 4, in the preferred construction, a spacer 140 is interposed laterally between the cylindrical wall 84 of tubular member 82 and the wire rope 72 of the tow line 70 in order to retain the wire rope 72 essentially aligned with the central axis 86. Such alignment of the tow line 70 along the central axis 86 maximizes the management of flexion of the tubular member 82 for optimum control of flexing of the towing units 22 in lateral directions. Spacer 140 preferably is an extruded synthetic polymeric structure having an outer cylindrical sleeve 142 for engaging the cylindrical wall 84, an inner cylindrical sleeve 144 for surrounding and locating the wire rope 72, and radial ribs 146 unitary with the outer and inner sleeves 142 and 144 for locating the sleeves 142 and 144 relative to one another.

A protective cover 150 is shown in the form of a sheath 152 slipped over the tubular member 82 of each towing unit 22 to extend longitudinally between the opposite ends 88 of the cylindrical wall 84 of the tubular member 82. Sheath 152 includes a layer 154 of resilient padding material, such as a resilient foamed synthetic polymeric material, and a fabric jacket 156 overlying the layer 154. Protective cover 150 serves a dual function of protecting against marring of surfaces of the personal watercraft 10 and the tow boat 16, as well as any other surrounding structures which could come in contact with the towing units 22 during use of the towing apparatus 20, and protecting against any similar damage during transportation and storage of the towing apparatus 20. In addition, the foamed resilient padding provides buoyancy sufficient to enable flotation of the towing units 22, and the apparatus 20, for easing retrieval, should the apparatus 20 fall into the water during coupling and uncoupling operations.

It will be seen that the managed flexion of the tubular members 82 of the towing units 22 enables appropriate movements of the towed personal watercraft 10 under all towing conditions, including close maneuvers during docking and mooring operations, while providing the control necessary to prevent mishaps. Hence, the present invention attains the several objects and advantages summarized above, namely: Enables a personal watercraft to be attached to a tow boat with the range of movements of the personal watercraft being controlled relative to the tow boat for preventing mishaps, such as capsizing of the personal watercraft or collision of the personal watercraft with the tow boat or with other boats and structures in the vicinity; facilitates maneuvering of the tow boat with the personal watercraft attached, during towing over open water and while making way in more confined waters, such as in channels and harbors; allows for convenient selective attachment and detachment of a personal watercraft and a tow boat; enables appropriate movements of a towed personal watercraft relative to a tow boat during towing, while precluding excessive movements which could upset or otherwise damage the personal watercraft or the tow boat; controls movement of the towed personal watercraft relative to the tow boat during docking and mooring maneuvers of the tow boat for facilitating docking and mooring operations; provides a relatively simple and inexpensive towing apparatus for personal watercraft, adapted for use in connection with a wide variety of tow boats; provides towing apparatus of the type described having a rugged and durable construction for exemplary performance over an extended service life.

It is to be understood that the above detailed description of a preferred embodiment of the invention is provided by way of example only. Various details of design and construction may be modified without departing from the true spirit and scope of the invention, as set forth in the appended claims.

The embodiments of the invention in which an exclusive property or privilege is claimed are defined as follows:

1. Towing apparatus for towing a personal watercraft at a desired towing distance behind a tow boat, the personal watercraft having a bow and a coupler adjacent the bow, and the tow boat having a stern, the towing apparatus comprising:

first and second elongate towing units, each towing unit having a first end, and a second end spaced longitudinally from the first end;

a linking member linking together the first ends of the elongate towing units, the linking member being linked to the first ends so as to enable the towing units to be spaced apart laterally from one another at the second ends;

a first coupling adjacent the linked first ends of the towing units for coupling the towing units with the coupler of the personal watercraft; and a second coupling adjacent the second end of each of the towing units for coupling each second end to the stern of the tow boat, with the second ends being spaced apart laterally;

each towing unit including a tow line extending longitudinally from the first end to the second end of the towing unit;

a tensioning member extending longitudinally along the tow line from the first end to the second end of the towing unit, the tensioning member including a wall having longitudinally opposite ends, the wall being laterally flexible and longitudinally resistant to compression for enabling managed flexion of the tensioning member, the managed flexion allowing controlled flexing in lateral directions while resisting compression in longitudinal directions; and a securing arrangement at each end of the wall for securing the tow line at each end of the wall, with the tow line maintained in tension and the wall in compression for enabling the managed flexion;

such that upon coupling the first coupling with the personal watercraft and coupling the second coupling with the tow boat, the managed flexion of the wall of each towing unit enables controlled lateral and altitudinal movements of the personal watercraft relative to the tow boat while maintaining the desired towing distance between the personal watercraft and the tow boat.

2. The invention of claim 1 wherein the linking member is linked to the first ends of the towing units so as to bring the first ends of the towing units into close proximity and to enable the towing units to diverge laterally from one another in a direction toward the second ends, thereby placing the towing units in a diverging array.

3. The invention of claim 1 wherein the wall of each towing unit is essentially straight between the first and second ends of the towing unit.

4. The invention of claim 3 wherein the wall of each towing unit is tubular and each tow line is placed within a corresponding tubular wall.

5. The invention of claim 4 wherein the tow line comprises a wire rope.

6. The invention of claim 4 wherein the tubular wall of each towing unit includes a central longitudinal axis, the invention including a spacer within the tubular wall of each towing unit, the spacer being placed laterally between the tow line and the tubular wall, longitudinally along the tubular wall, to retain the tow line essentially aligned with the central longitudinal axis of the tubular wall.

7. The invention of claim 6 wherein the tubular wall is constructed of a fiber reinforced synthetic polymeric material.

8. The invention of claim 7 wherein the tow line comprises a wire rope.

9. The invention of claim 8 including a sheath having padding material extending over each tubular wall, along the longitudinal length between the first and second ends of the tubular wall.

10. The invention of claim 9 wherein the padding material is buoyant for providing flotation to each towing unit sufficient for floating the towing apparatus.

* * * * *